US006481836B1

(12) United States Patent
Paroff et al.

(10) Patent No.: US 6,481,836 B1
(45) Date of Patent: Nov. 19, 2002

(54) MODULAR INK MOUNTING ASSEMBLY AND INK DELIVERY SYSTEM

(75) Inventors: Paul J. Paroff, East Amherst; Kenneth C. Chapin, Grand Island; Daniel E. Kanfoush, Niagara Falls; Mark Ruchalski, West Seneca; Anthony Moscato, North Tonawanda; Roger J. Rowland, Niagara Falls; Daniel C. Radice, Eden; Phillip C. Jerzak, Grand Island, all of NY (US)

(73) Assignee: Moore Business Forms, Inc., Grand Island, NY (US)

( * ) Notice: Subject to any disclaimer, the term of this patent is extended or adjusted under 35 U.S.C. 154(b) by 1086 days.

(21) Appl. No.: 08/661,178

(22) Filed: Jun. 10, 1996

(51) Int. Cl.[7] ..... B41J 2/175
(52) U.S. Cl. ..... 347/85
(58) Field of Search ..... 347/84, 85, 86, 347/87, 34, 37; 141/234, 35; 222/143, 318, 424, 129

(56) References Cited

U.S. PATENT DOCUMENTS

| | | | | |
|---|---|---|---|---|
| 4,178,595 | A | 12/1979 | Jinnai et al. | |
| 4,628,331 | A | 12/1986 | Ishikawa | |
| 4,628,332 | A | 12/1986 | Matsumoto | |
| 4,755,836 | A | 7/1988 | Ta et al. | |
| 4,800,398 | A | 1/1989 | Naruse et al. | |
| 4,990,938 | A | 2/1991 | Brandon et al. | |
| 5,065,170 | A | 11/1991 | Rezanka et al. | |
| 5,241,325 | A | 8/1993 | Nguyen | |
| 5,367,328 | A | 11/1994 | Erickson | |
| 5,428,375 | A | 6/1995 | Simon et al. | |
| 6,196,668 | B1 * | 3/2001 | Bode | 347/85 |

* cited by examiner

*Primary Examiner*—Judy Nguyen
(74) *Attorney, Agent, or Firm*—Nixon & Vanderhye PC

(57) ABSTRACT

A modular ink delivery system using ink jet heads effectively supplies ink to a multi-level array of ink jet heads, and ensures that the heads remain in position during printing even if there is vibration of the supporting structures. Delivery is provided by a number of ink containing chambers, at least one for each level and stacked one atop the other. A connection extends from each chamber to at least one ink jet, and ink is automatically supplied to all of the chambers for example by pumping ink to the upper of the chambers, the ink then cascading downwardly from each upper chamber to a lower chamber through standpipe connections between them. The heads are positively held in place by a first circular bar and a second non-circular bar, which bars are operatively engaged by a mounting block for each head for guided movement. A tightenable screw and spring plunger may cooperate with an arcuate bushing for engaging the first bar, and a channel on a releasable clip and rollers on a portion of the mounting block may engage the second bar.

30 Claims, 7 Drawing Sheets

MODULAR INK MOUNTING ASSEMBLY AND INK DELIVERY SYSTEM

BACKGROUND AND SUMMARY OF THE INVENTION

There are many circumstances, especially in the printing of continuous paper webs or sheets, where it is desirable to provide a plurality of ink jet devices each with one or more nozzles for spraying ink onto a surface (e.g. a stationary or moving paper web or sheet) to print indicia thereon. Such systems confront a number of different practical problems especially where mounted in a multi-level array.

For ink jet heads in a multi-level array, typically with a plurality of ink jet heads at each level, it is difficult to properly and effectively deliver ink to the heads so that all of the heads are provided with a substantially uniform and appropriate supply of ink. Also, typically the heads in the arrays are fixedly mounted to the supporting bars or other structures to ensure that each ink jet head remains in position during printing. This fixed mounting has been considered necessary because there is vibration of the equipment that includes the ink jet heads, either internally created in the equipment or from surrounding machinery. However when an ink jet head wears out or becomes defective it is typically necessary to shut down the entire production line while the array is disassembled and the individual ink jet head is removed. Removal of the defective head thus slows down production and increases the costs of operation. If the defective ink jet head is not removed then the array print quality may be adversely affected leading to discarding some or more of the run.

According to the present invention various systems are provided which directly confront the problems set forth above, and result in advantages and improved functionality compared to the conventional prior art systems. According to the present invention a modular ink delivery system is utilized which takes advantage of a cascading flow of ink in a plurality of containers, at least one of the containers associated with each level of the array, to properly provide the ink to the arrays, and with the necessity of only a single pump. Also the invention provides a system in which individual ink jet heads are positively guided for movement from one position to the next so that they are adjustable, and also so that they are readily removable. In fact according to one embodiment of the invention each individual ink jet head can be removed without any adverse affect whatsoever on any of the surrounding heads on any level.

According to one aspect of the present invention a modular ink delivery system for a multi-level array of ink jet heads is provided comprising the following components: A plurality of arrays of ink jet heads, at least one ink jet head provided in each array, and the arrays provided on a plurality of vertically spaced levels. A plurality of ink containing chambers, at least one for each array, positioned approximately at the level of the respective arrays, stacked one atop the other, each chamber having a top and a bottom, the bottoms of at least some chambers operatively engaging the tops of others. A connection from each chamber to the at least one ink jet head of the array associated with the chamber. And, means for automatically supplying ink to all of the chambers.

Preferably each of the chambers described above has a fluid connection between it and any chamber immediately above or below it. The means for automatically supplying ink to all of the chambers may be very simple. For example it may comprise a pump and a conduit leading from the pump to an upper of the chambers for feeding ink into a top portion of the upper of the chamber so that the ink cascades downwardly from the upper chamber to lower chambers through the fluid connections between the chambers. Each of the fluid connections may comprise a standpipe, and each chamber, except the top chamber, has a first standpipe connected to the top thereof and a second standpipe connected to the bottom thereof. The first and second standpipes are arcuately offset from each other at least about 90°, preferably about 180°.

The ink jet heads of an array are connected to a chamber associated therewith at a first vertical position. The bottom standpipe in the chamber has an open top disposed at a second vertical position higher than the first vertical position so that the chamber supplies ink to the ink jet heads connected thereto before cascading ink to a lower chamber. Each ink jet of the array may be connected to the chamber by a separate hose fitting.

A single lid may provide the bottom of a first of the chambers and the top of a second of the chambers, the lid having at least one O-ring (or like seal) associated therewith for sealing with the interior of the second chamber. The lid may be substantially permanently sealingly affixed to the interior of the first chamber. Typically the ink provided in the chambers has a viscosity of between about 1.4–2 centipoise, and a surface tension of between about 35–50 dynes per centimeter. The chamber and array at each level are preferably connected together by conduits and a vacuum degasser for de-aerating ink flowing from a chamber to an array. The vacuum degasser may be provided between the chamber and each of the ink jet heads in the array.

There may be a common support structure within which the chambers are stacked one atop the other. The common support structure may include a clamp for clamping the chambers therewithin. An ink reservoir is connected to a single pump for supplying the chamber with ink, by a first conduit, and a second conduit connected to the bottom portion of the lowermost of the stacked chambers returns ink to the reservoir by gravity flow. The clamp may be loosened and the chambers then unstacked for cleaning or replacement.

According to another aspect of the present invention, a particular mounting structure is provided for the ink jet heads that allow replacement of individual heads without necessarily having to shut down the entire line. The mounting structure is ideally utilizable with the modular, multi-level, ink delivery system described above, although it may be used in single level arrays too. When used in a multi-level array at each level a first generally horizontally extending bar is provided with first means for mounting each of the ink jet heads on the first bar so that the ink jet heads are securely held to the first bar, but are readily removably individually detached from the first bar for repair or replacement without affecting others of the ink jet heads on any level. The first mounting means may comprise: a heat sink having a top and a bottom; an ink jet head and an electrical connection element for supplying activation signals to the ink jet head mounted on top of the heat- sink; and a releasable attachment to the first bar mounted to the bottom of the heat sink. At each level a second generally horizontally extending bar may also be provided, as well as second means for mounting each of the ink jet heads on the second bar so that the ink jet heads are readily movable with respect to and guided by the second bar. The first and second bars are substantially parallel to each other and spaced from each other. The first bar may be substantially circular in cross-section and the second bar distinctly non-circular in cross-section (e.g. typically polygonal, e.g. rectangular).

According to another aspect of the present invention a modular ink jet assembly is provided comprising the following components: A plurality of ink jet heads provided in an array. A first generally horizontally extending bar. A second generally horizontally extending bar substantially parallel to the first bar. And, for each ink jet head: first mounting means for mounting the ink jet head on the first bar so that the ink jet head is securely held to the first bar but is readily movable along the first bar; second mounting means for mounting the ink jet head on the second bar so that the head is readily movable along and guided by the second bar an electrical connection element mounted by the first and second mounting means for supplying activation signals to the ink jet head.

The first and second mounting means may include a heat sink having a top and a bottom, the electrical connection element and the ink jet head mounted on top of the heat sink; and an attachment to the first and second bars mounted to the bottom of the heat sink.

Typically the second bar has first and second side edges (e.g. is polygonal or otherwise distinctly non-circular), and a bottom. The attachment to the first and second bars mounted to the bottom of the heat sink typically comprises: an arcuate bushing, having an arcuate extent of at least about 100°, for engaging the first bar; a removable clip with a channel for engaging the bottom of the second bar adjacent its first side edge; and at least one roller and cooperating support for the roller for engaging the bottom of the second bar adjacent its second side edge. The arcuate bushing preferably has an arcuate extent of 180° or less, and the first mounting means further comprises a first screw movable with respect to the bushing into a position tightly holding the arcuate bushing in a stationary position with respect to the first bar. The first mounting means may also further comprise at least one spring pressed plunger extending from the arcuate bushing into contact with the first bar.

According to yet another aspect of the present invention a modular ink jet assembly is provided comprising the following components: A plurality of ink jet heads provided in an array. A first generally horizontally extending bar. A second generally horizontally extending bar substantially parallel to the first bar. An arcuate bushing, having an arcuate extent of at least about 100°, for engaging the first bar. A removable clip with a channel for engaging the bottom of the second bar adjacent the first side edge thereof. And at least one roller and cooperating support for the roller, for engaging the bottom of the second bar-adjacent the second side edge thereof. The details of the components preferably are as described above.

According to yet another aspect of the present invention a system is provided comprising: A plurality of ink jet heads provided in an array. A first generally horizontally extending bar. And, for each ink jet head: first mounting means for mounting the ink jet head on the first bar so that the ink jet head is securely held to the first bar but is readily movable along the first bar and individually detachable from the first bar for repair or replacement without affecting others of the ink jet heads, the first mounting means comprising an open channel-defining bushing engaging the first bar, at least one spring pressed plunger biased into engagement with the first bar in the bushing, and a first screw movable with respect to the bushing into a position tightly holding the arcuate bushing in a stationary position with respect to the first bar, and an electrical connection element mounted by the first mounting means for supplying activation signals to the ink jet head.

Oftentimes there is wayward (not properly directed) mist from the ink droplets issuing from the nozzles associated with the ink jet heads. This wayward mist can adversely affect the print quality of the web or sheet being printed. The mist may provide unwanted specs on the web or sheet being printed, and/or may build up on the ink jet devices, causing poor operation, or even precluding operation. It is for that reason that an ink mist absorbing device, such as a piece of porous metal, is interposed between a paper sheet and an ink head as seen in U.S. Pat. No. 4,628,331, or material having an affinity for ink is moved across the ink jet head adjacent the nozzle such as shown in copending application Ser. No. 08/277,075 filed Jul. 19, 1994, now U.S. Pat. No. 5,557,301. This problem may also be approached, according to the present invention, by mounting a sintered metal (of magnetic material or having a magnetic material attached) plate with respect to the front surface of an ink jet head (which has at least one nozzle for spraying ink therefrom) for absorbing wayward ink in ink mist issuing from the nozzle or rebounding from the paper or other surfaces onto which ink is directed. The mounting structure may comprise a magnet and a spring, such as a leaf spring, so that the sintered metal plate is readily releasably properly positioned with respect to the front surface and can be easily replaced.

It is a primary object of the present invention to provide for the effective ink jet printing of webs or sheets, particularly in the effect supply of ink to a multi-level array of ink jet heads, and in the proper mounting of the ink jet heads. This and other objects of the invention will become clear from an inspection of the detailed description of the invention and from the appended claims.

DETAILED DESCRIPTION OF THE DRAWINGS

Figure 1:
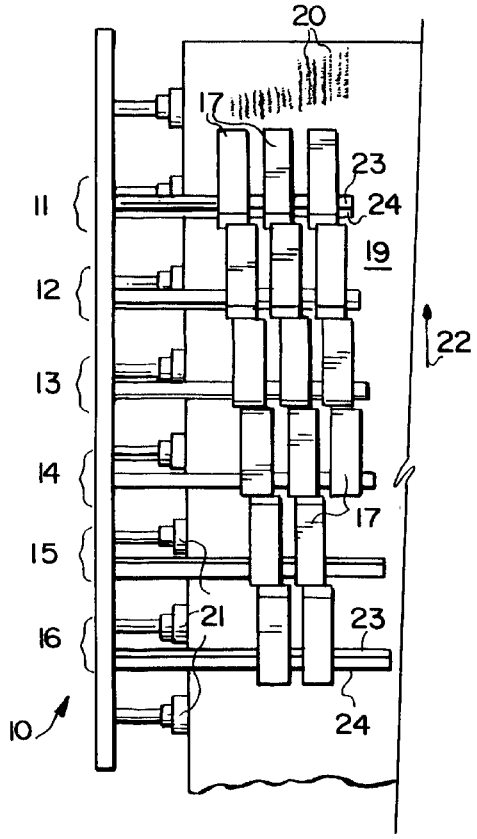
FIG. 1 is a schematic rear view showing a multi-level array of ink jet heads (cartridges) for printing a web.

FIG. 1 schematically illustrates a plurality of arrays of ink jet heads in an ink jet imaging system 10 according to the present invention. In the system 10 there are six levels, designated 11 through 16, respectively, each level 11 through 16 including an array of ink jet heads, at least one ink jet head 17—and preferably a plurality of such heads 17—being provided at each level 11 through 16, in each array. The ink jet heads 17 are per se conventional, such as modified Canon BJ cartridges. Each of the heads 17 has one or more nozzles associated therewith for spraying ink therefrom. The nozzles are not visible in FIG. 1, but are seen in the area 18 in schematic form in FIG. 7. As is conventional for ink jet cartridges, droplets of ink issue from the heads 17 and impact a web or sheet 19 (preferably a continuous web of paper) which is to be printed, forming desired indicia and images 20 thereon. The web 19 is guided by conventional rolls 21 on the opposite side of the web 19 from the heads 17, one or more of the rolls 21 being powered, or some sort of accessory web moving device (not shown) being associated with the system 10 for either continuously or incrementally moving the web 19 in the direction 22 as seen in FIG. 1.

The heads 17 are each preferably mounted on first and second generally horizontal, substantially parallel, mounting bars 23, 24, respectively. The mounting bars 23, 24 are only shown schematically in FIG. 1 and will be described in more detail below.

Figure 2:
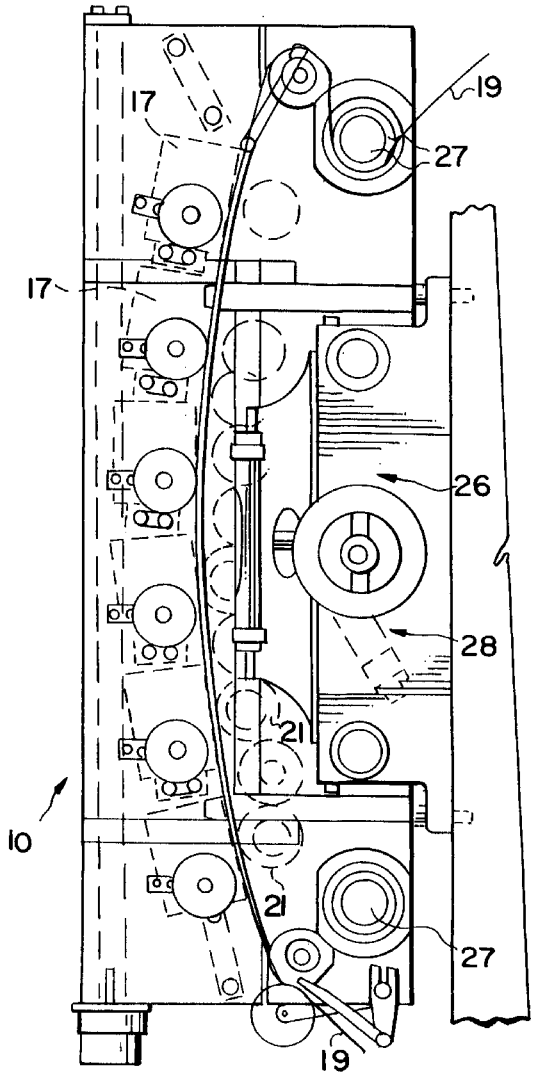
FIG. 2 is a schematic side view of the multi-level array of FIG. 1.

FIG. 2 is a schematic side view of the system 10 of FIG. 1 with the rollers 21 and the heads 17 merely being shown in phantom. The system 10 may include a precision leveling device shown schematically by reference numeral 26 for making the side frames square, may include an encoder roller or rollers 27, a pneumatic throw-off cylinder shown only schematically at 28 to move the rollers 21 so that they do not apply pressure or tautness against the web 19 (to facilitate splicing), and other accessory structures may be provided. These details do not relate specifically to the present invention, however, and these structures are all optional and can have any suitable configuration within the purview of the present invention.

Figures 3, 4:
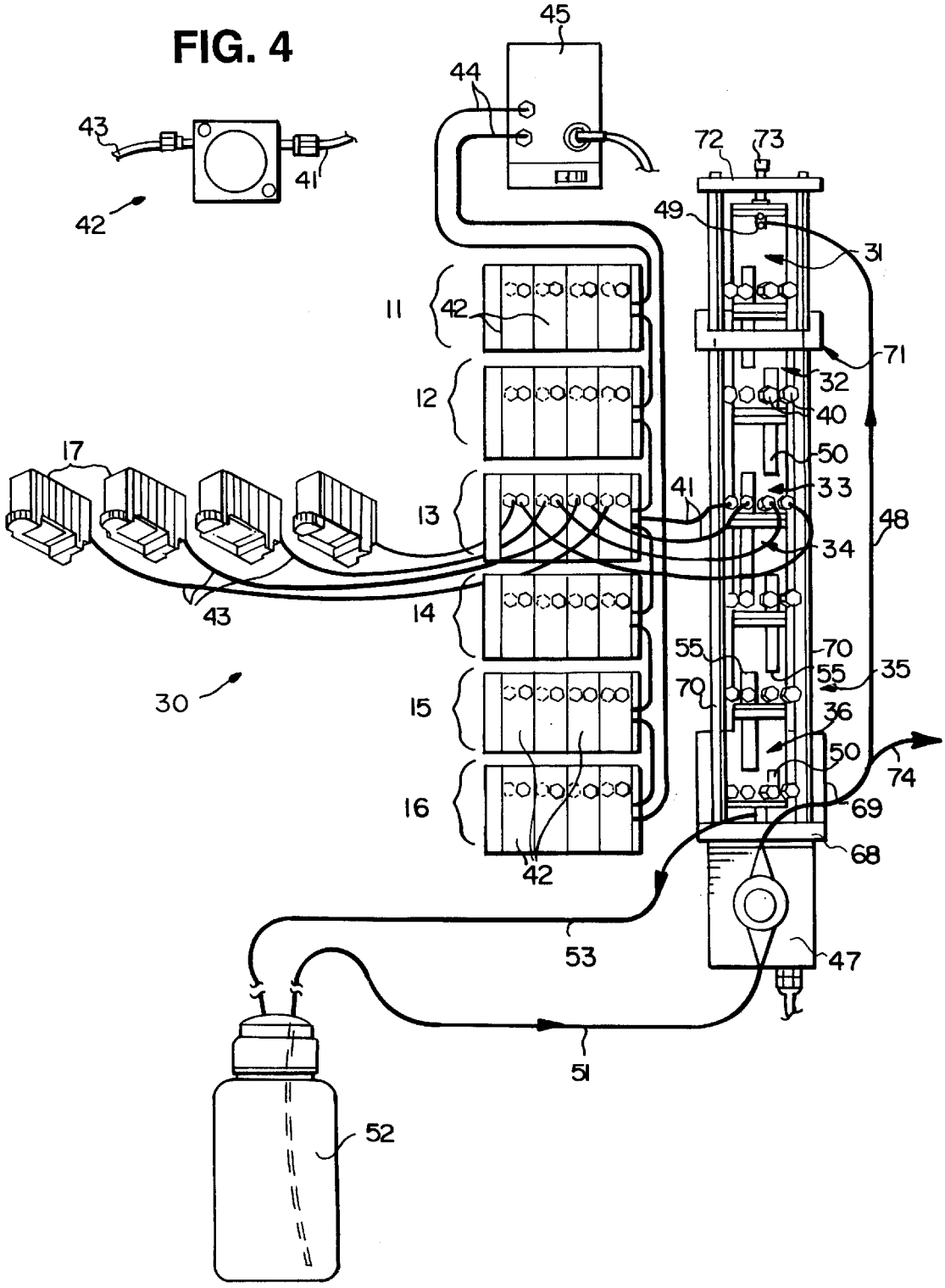
FIG. 3 is a schematic illustration, partly in side view, partly in end view, and partly in perspective, of an exemplary ink delivery system according to the present invention.
FIG. 4 is a side schematic view of an exemplary degasser of the system of FIG. 3.
Figure 5:
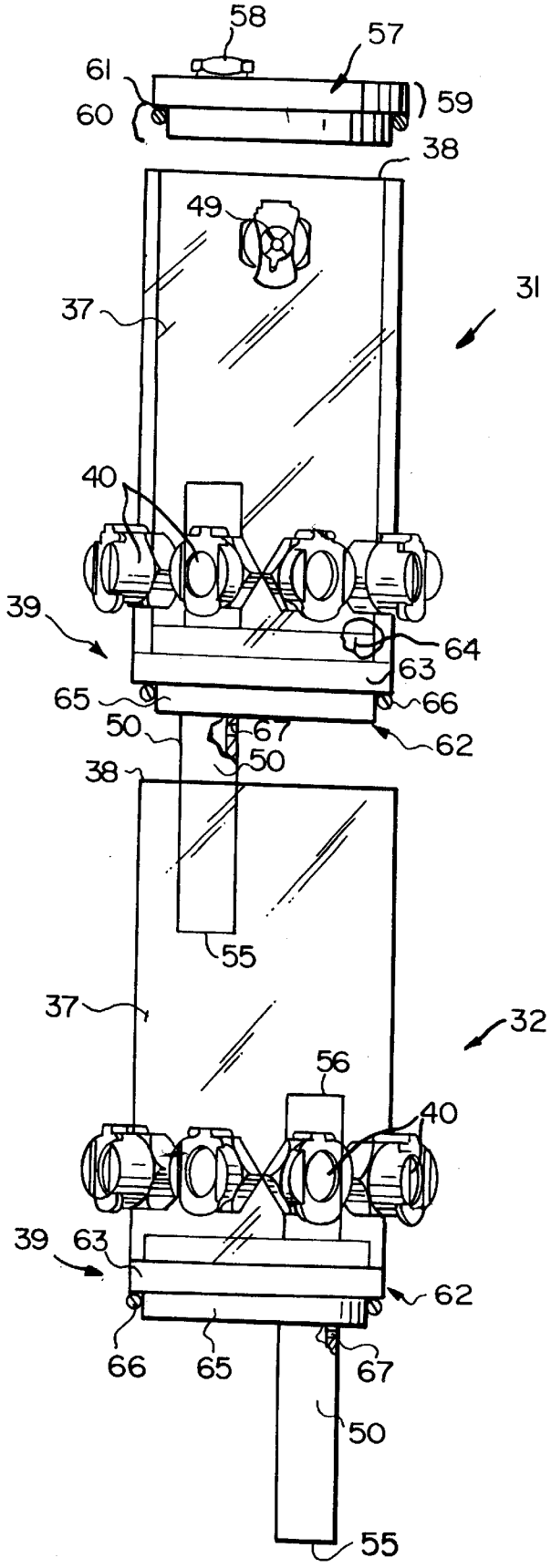
FIG. 5 is a side exploded view of the top and second ink containing chambers of the ink delivery system of FIG. 3.

FIGS. 3 through 5 illustrate the modular ink delivery system—shown generally by reference numeral 30 in FIG. 3—for the multi-level array of ink jet heads 17 illustrated in FIG. 1. While in FIGS. 1 through 3 six levels 11 through 16 are illustrated it is of course understood that any number of levels may be provided. In FIG. 3 four ink jet heads (cartridges) 17 are illustrated in association with each level 11–16, although any number of ink jet heads 17 may be associated with each level, and in FIG. 3 only the ink jet heads 17 associated with the level 13 are actually illustrated. The levels 11 through 16 are vertically spaced from each other as illustrated in all of FIGS. 1 through 3.

The delivery system 30 includes a plurality of ink containing chambers or cups, 31 through 36, at least one chamber or cup 31–36 for each level 11 through 16, and positioned approximately at (e.g. slightly below the plane of the level 11 through 16 to which the chamber 31–36 will be supplying ink, e.g. about one-quarter inch below the plane) the level of each of the arrays of heads 17 for each of the levels 11 through 16. The chambers 31 through 36 are vertically stacked, one atop the other, as seen in FIG. 3. The spacing between the levels 11 through 16 is such so that mounting assemblies for each of the ink jet heads 17 can be easily inserted and removed from the bars 23, 24 without interfering with the other assemblies (e.g. a spacing of about four inches is practical).

Two of the chambers, chambers 31 and 32, are illustrated in FIG. 5, it being understood that the rest of the chambers 33 through 36 are substantially identical to chamber 32. Each of the chambers 31, 32 comprises a tube 37 which preferably is made of transparent plastic, having an open top 38 and a bottom—shown generally at 39 in FIG. 5—which is sealed as will be hereafter described. As seen in FIG. 3 the bottoms 39 of some chambers operatively engage the tops 38 of others (in this embodiment the bottoms of all of the chambers 31 through 35 engage the tops of other chambers 32 through 36).

Each of the tubes 37 of each of the chambers 31 through 36 has a connection to at least one ink jet 17 of an array at the level 11 through 16 associated with that chamber. In the exemplary embodiment illustrated in FIGS. 3 through 5 this connection is provided by a conventional ink outlet hose fitting 40 for each ink jet 17 to which the tube 37 will ultimately be connected. In the exemplary embodiment illustrated there are four such hose fittings 40, but any number may be provided. The conventional hose fittings 40 connect to hoses 41 (see FIG. 3), which in the embodiment illustrated in FIGS. 3 and 4 connect through vacuum degassers 42 to another hose 43 leading to a head 17. The degassers 42, which are commercially available, are connected via vacuum lines 44 to a common vacuum pump 45. The degassers 42 remove a significant portion of any air entrained in the ink, which air may become entrained in the ink due to the delivery of the ink from the reservoir, and in a cascading manner through the chambers 31 through 36. The tubes 41, 43 preferably are polyethylene self-sealing tubes, and while desirably of flexible material may if necessary be made of a more rigid material.

Means are provided for automatically supplying ink to all of the chambers 31 through 36. This automatic supply means may take the form of an overhead tray which has a head, a gravity flow arrangement, or utilizing a wide variety of conventional powered devices. In the preferred embodiment illustrated in FIG. 3, however, the automatic supply means includes a conventional pump 47 and a conduit 48 leading from the pump 47 and connected to the top of the chambers 31, e.g. to the conventional hose fitting 49 (seen in both FIGS. 3 and 5) in the side wall adjacent the top of the tube 37 of the top chamber 31. The ink fed via conduit 48 into the top chamber 31 cascades downwardly from the upper chamber 31 to lower chambers 32 through 36 through fluid connections between them. The fluid connections preferably are in the form of standpipes 50, seen most clearly in FIG. 5. Ink may be supplied to the pump 47 through a supply line (which may be a flexible tube) 51 connected to an ink reservoir 52. A return line 53 (which preferably is straight with no dips) may return excess ink from the bottom of the bottom chamber 36 (e.g. connected to the bottom of the standpipe 50 thereof) back to the reservoir 52.

As seen in FIG. 3, and as would be seen in FIG. 5 if the chambers 31, 32 were moved into sealing engagement with each other, the open bottom 55 of a standpipe 50 associated with the top of any particular chamber 32 through 36 is at substantially the same level as the open top 56 of the standpipe 50 associated with the bottom of that chamber. Also the standpipes 50 associated with any particular chamber are arcuately offset from each other around the chamber 32–36 at least about 90°, and preferably about 180° (as illustrated in FIGS. 3 and 5) in order to prevent ink from flowing straight from the open bottom 55 of the standpipe 50 associated with the top of that chamber to the open top 56 of the standpipe 50 associated with the bottom of that chamber.

The open top 38 of the first chamber 31 is preferably sealed by a lid 57 which may have a breather plug 58 therein, and has a stepped diameter with the larger diameter portion 59 larger than the inside diameter of the tube 37, and the smaller diameter portion 60 slightly smaller than the inside diameter of the tube 37. An O-ring 61, or like flexible or deformable sealing element, is provided to form a fluid tight seal between the lid 57 and the tube 37.

At the bottom of each of at least the chambers 31 through 35 is a "lid" 62 which simultaneously forms the bottom of the upper chamber associated therewith (e.g. the chamber 31 for the uppermost lid 62), as illustrated in FIG. 5, and the removable top of the next lowest chamber (the chamber 32 in FIG. 5) in the stack. Preferably the lid 62 forms a permanent bottom of the upper tube 37 with which it is associated. For example the enlarged diameter center portion 63 of the lid 62, as well as the outer periphery of the upper smaller diameter portion 64 thereof, may be permanently affixed and sealed (completely liquid-tight) to the bottom edge and the interior of the tube 37 by ultrasonic or other welding techniques, or by using an adhesive, such as PVC cement. The bottom lower diameter portion 65 of the lid 62 is substantially the same as the portion 60 of the lid 57, and also preferably has an O-ring 66 or like sealing element associated therewith corresponding to the O-ring 61 for the lid 57.

Each of the standpipes 50 may have drain hole 67 (see FIG. 5) associated therewith located just below the lid 62, through which the standpipe 50 extends. The standpipe 50 is preferably held tightly within the lid 62 so that there is no leakage around the standpipe 50 from one tube 37 to the next; rather the only ink flow from one tube 37 to the lower tubes that is possible is through the open interiors of the standpipes 50.

As seen in FIG. 3 when the chambers 31 through 36 are assembled together in a stack they are in sealed relationship with respect to each other, the O-rings 61, 66 sealing each chamber 31–36 from the others, so that the only ink flow is through the standpipes 50. Preferably a common support structure is provided for mounting the chambers 31 through 36 in their stacked position. One exemplary form that this common support structure may take is illustrated schematically in FIG. 3. This common support structure preferably includes a base 68 which can be securely fastened, e.g. by screws, to the pump 47, or supported by another secure substantially horizontal surface. Attached to the base 68 may be a support bracket or collar 69 which securely mounts, so that there is little deflection, two or more support columns 70. An upper bracket 71 may be clamped to the columns 70 at one or more positions above the base 68 in order to provide more secure support, such as—as illustrated in FIG. 3—at a portion of the chamber 32 above the hose fittings 40. At the top of the common support structure there preferably is a top disc 72 which not only secures the column 70 together in a desired position, but may include a center clamping screw 73 which screws through the disc 72 and can be tightened into abutment with the lid 57 so as to provide a downward force on the upper chamber 31.

Also as illustrated in FIG. 3, the conduit 48 may include a branch 74 which may lead to a like series of chambers 31 through 36, and/or to a conventional pressure switch which ensures that the pump 47 output pressure is neither too high or too low. For ease of operation and so that a desirable size and construction of the pump 47 may be utilized, it is preferred that the total distance from the upper hose fitting 49 for the line 48 from the pump 47, and the bottom of the ink reservoir 52, is a maximum of about six feet.

FIGS. 6 through 13 relate to a mounting structure according to the invention for mounting the individual ink jet heads 17 so that they are positively fixed in the position to which they are moved for imaging even if subjected to the vibrations commonly associated with the associated machinery, yet can be removed when they wear out or become defective, and may be readily adjusted in the position in which they are disposed for printing, if desired.

As seen in the embodiment of FIGS. 6 through 12, a mounting structure in general for mounting the ink jet head 17 is shown by reference numeral 76. It includes a first mounting means for mounting the ink jet head 17 to the first bar 23 so that the ink jet head 17 is securely held to the first bar 23 but is readily movable along the first bar 23, and can be readily detached therefrom. Also a second mounting means is provided for mounting the ink jet head 17 on the second bar 24 so that the head 17 is readily movable along and guided by the second bar 24. While the first and second mounting means may comprise very distinct elements that are ultimately connected together by fasteners, in the preferred embodiment illustrated in the drawings the first and second mounting means are provided by different parts of the same structure.

Figure 6:
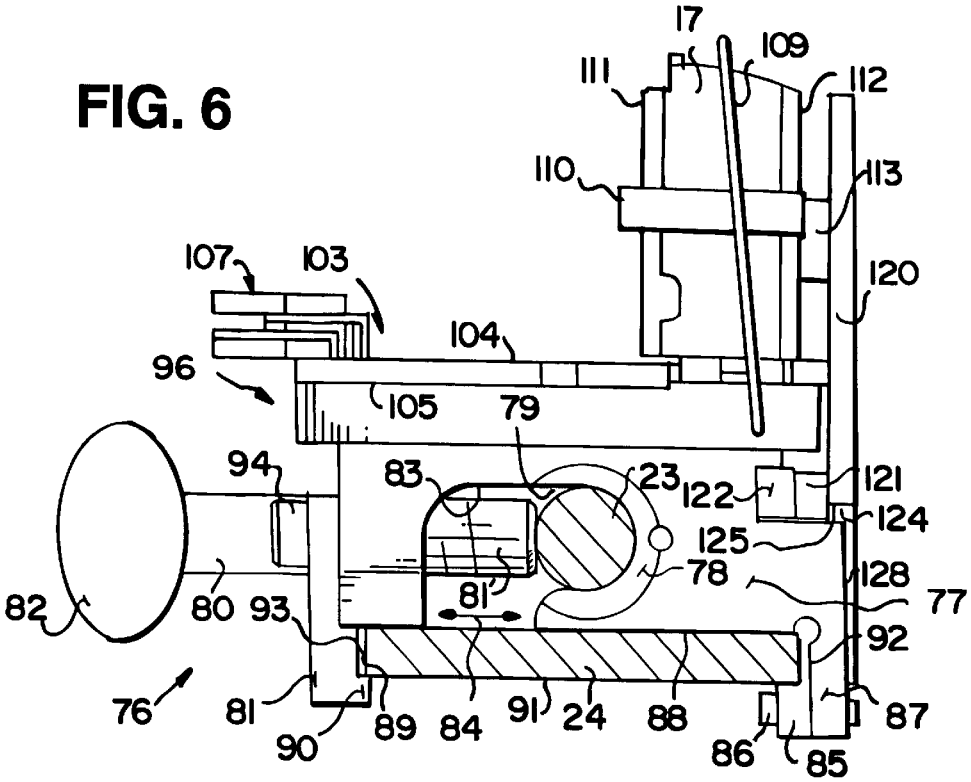
FIG. 6 is a side view, partly in cross-section and partly in elevation, of a first embodiment of an exemplary mounting arrangement for mounting the ink jet heads of the array of FIGS. 1 and 2 for movement, with the mounting bars shown in cross-section.

Preferably the first and second mounting means comprise a common block 77, typically of metal, having a bronze bushing 78 therein. As illustrated in FIG. 6 the bushing 78 is preferably arcuate so that it corresponds to the preferred substantially circular cross-section of the first bar 23, and preferably has an arcuate extent of at least about 100°, but of 180° or less, so that it may be readily moved into engagement with the first bar 23. Preferably one or more spring pressed plungers 79 are provided which extend through the bushing 78 or another portion of the block 77 into engagement with the bar 23. Each plunger 79 preferably comprises a metal cap that is pressed by a coil spring within the block 77, which structure is conventional per se. The plunger or plungers 79 is or are preferably positioned as illustrated in FIG. 6 so that when the bar 23 is moving into association with the bushing 78 the bar 23 depresses the plunger 79, and after it moves past the plunger 79 the plunger 79 moves out away from the bushing 78 so that the bar 23 actually "snaps" into place.

Normally the plunger 79 cannot apply a sufficient force to positively hold the block 77 in place on the bar 23, especially in view of the vibration of the components. Therefore to positively facilitate secure positioning a brass thumb screw 80 is provided. The thumb screw 80 has threads 81' formed over a significant part of the length thereof, and is in threaded engagement with the block 77 and/or a clip 81. The enlarged, flat, head 82 of the screw 80 may be readily engaged by the thumb and forefinger of an operator to tighten the screw 80 securely into contact with the outer periphery of the bar 23, or to retract it away from the channel 83 provided in the block 77. The channel 83 has an open mouth 84 which is at least as large as the diameter of the first bar 23, and the channel 83 is dimensioned and configured—such as is illustrated in FIG. 6—to allow ready movement of the block 77 with respect to the bar 23 so that the bar 23 can come into association with the bushing 78 as illustrated in FIG. 6.

The second mounting means aspect of the block 77 includes one or more (preferably two) rollers 85, which preferably comprise small wheels with interior roller bearings mounted on a shoulder bolt or shaft 86 on a roller support structure 87 extending downwardly from the main part of the block 77, as illustrated in FIG. 6, and integral therewith. The tops of the rollers 85 are spaced from the bottom 88 of the main portion of the block 77 a distance that is slightly greater than the width of the second bar 24, which second bar 24 is distinctly non-circular in cross-section, and preferably is of a polygonal shape, such as the rectangular cross-section illustrated in the preferred embodiment in FIG. 6. The clip 81 also has a channel or groove 89 formed therein for receipt of the opposite end of the bar 24 from that portion which engages the roller 85. In other words—as illustrated in FIG. 6—the clip 81 will have a bottom extension 90, below the groove 89, which engages the bottom 91 of the second bar 24, while the tops of the rollers 85 will also engage the bottom 91 of the second bar 24. The sides 92, 93 of the second bar 24 will be disposed between the roller support 87 and the groove 89, which may engage the sides 92, 93 as long as they do not bind the bar 24.

The clip 81 is preferably removably held in contact with the block 77 by a screw 94, or other readily removable fastener. When the screw 94 is screwed out of the block 77, the clip 81 is readily removed and the block 77 may readily be moved out of operative contact with the second bar 24 since the clip 81 no longer holds the structure 76 in operative association with the bar 24.

Figure 8:
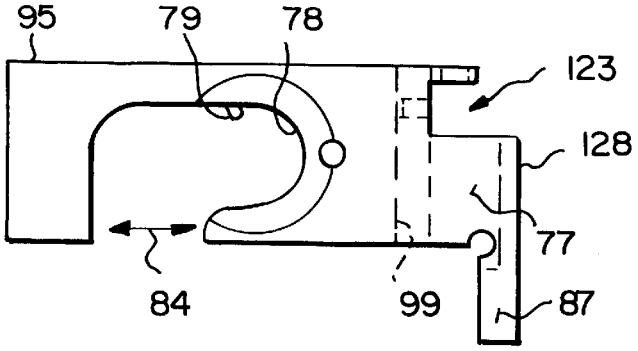
FIG. 8 is a side detail view of the mounting block of the apparatus of FIGS. 6 and 7.

FIG. 8 shows the block 77 detached from the clip 81, and with the shoulder bolts/shafts 86 also detached therefrom, and with the structure otherwise mounted to the top surface 95 thereof also removed.

Figure 9:
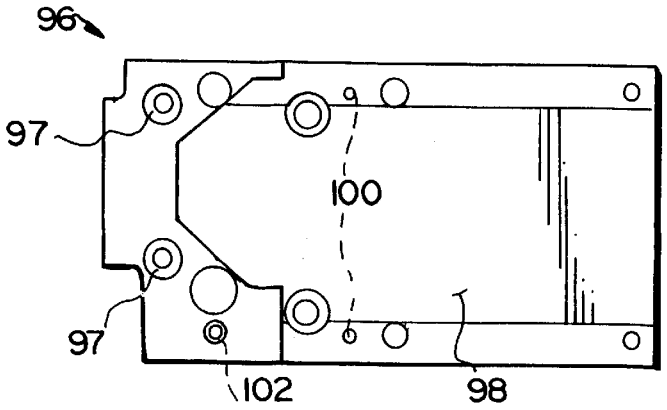
FIG. 9 is a top plan view of the heat sink component of the apparatus of FIG. 6.
Figure 10:
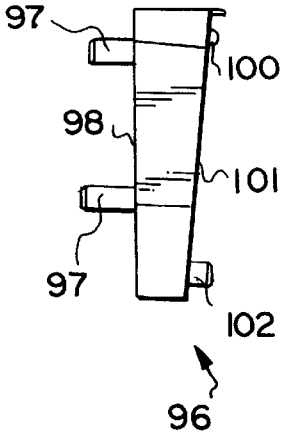
FIG. 10 is a front end view of the heat sink of FIG. 9.
Figure 11:
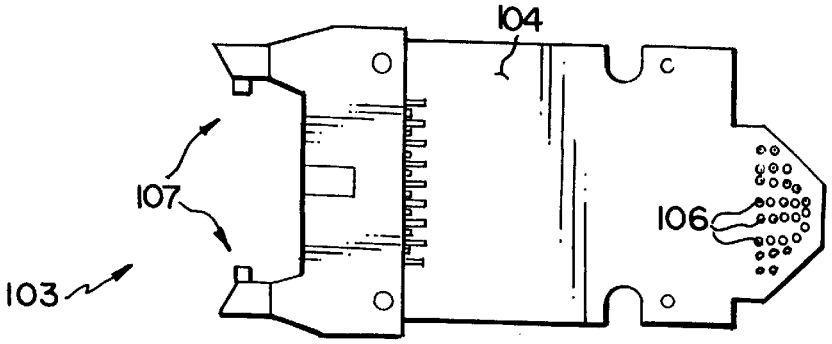
FIG. 11 is a top plan view of the electrical connection component of the apparatus of FIG. 6.
Figure 12:
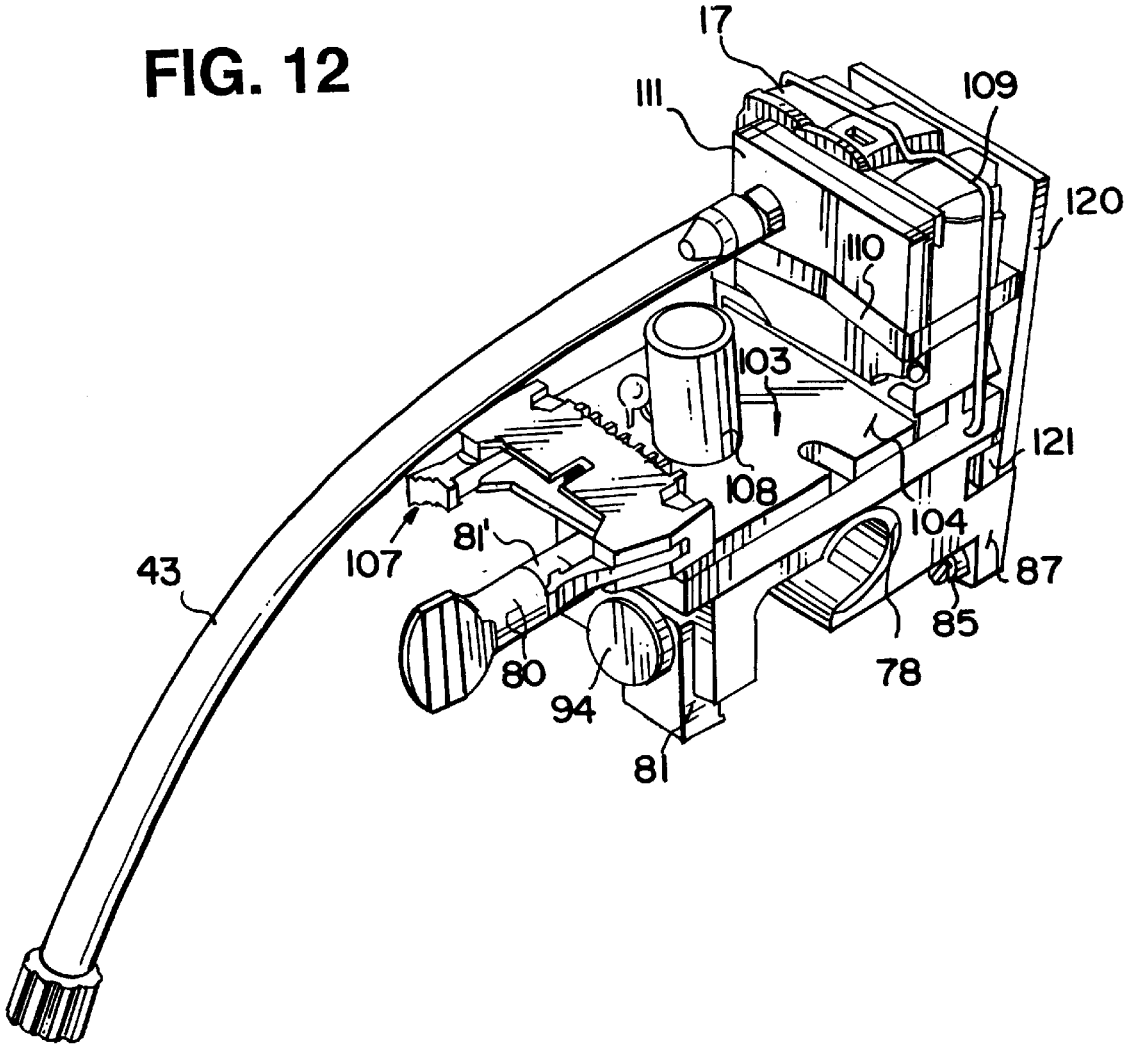
FIG. 12 is a top perspective view of the apparatus of FIG. 6 without the guide rod or bar.

As seen in FIG. 6 normally a heat sink—shown generally by reference numeral 96—is disposed in contact with the top 95 of the mounting block 77. The heat sink 96 is preferably constructed primarily of copper, aluminum, or materials with like heat sink properties. For example the heat sink 96 may be of copper and have a length of about 2.7 inches, a width of about 1.5 inches, and a thickness of about 0.3 inches. The heat sink 96 per se—detached from the block 77 and the other associated structures—is seen most clearly in FIGS. 9 and 10. The heat sink 96 preferably includes hardened dowel pins 97 which extend downwardly from the bottom surface 98 thereof into cooperating openings 99 (see the phantom line opening 99 in FIG. 8) in the block 77. Also unhardened dowel pins 100 (the position of the dowel pins 100 is seen in FIG. 9 but the pins themselves extend outwardly from the top face 101 of the heat sink 96, not from the bottom face 98 thereof), and a locator pin 102 also is provided extending upwardly from the face 101 (only the position of the locator pin 102 being seen in FIG. 9, the pin itself not extending downwardly from the surface 98). The pins 100, 102 cooperate with an electrical connection element shown generally by reference numeral 103 in FIGS. 6 and 11, the electrical connection element 103 for supplying activation signals to the ink jet head 17, and mounted in contact with (and heat transfer relationship with) the top surface 101 of the heat sink 96.

The electrical connection element 103 includes a top surface 104 which supports the ink jet head 17, and a bottom surface 105 (see FIG. 6) engaging the top surface 101 of the heat sink 96. At the end of the element 103 underneath the ink jet head 17 are a plurality of electrical connector elements 106 (see FIG. 11) such as those commonly known as "Pogo contacts", the structure 103 also being known as a "Pogo pin board". For example about twenty to thirty pins 106 may be provided (e.g. twenty-nine for a conventional ink jet head 17).

Mounted on the opposite end of the element 103 from the pins 106 is a connector 107 which is used to provide an actual mechanical and electrical connection to a cable which leads to a conventional electronic control for supplying electrical control signals through the element 103 to the ink jet head 17. For example the structure 107 may be a conventional nanoflex header-circuit assembly. Preferably a flexible cable is readily releasably attached to the structure 107 which leads back to a common conventional control (not shown).

The ink jet head 17 is mechanically and electrically connected to the pins 106, and has a bottom surface which engages the top surface 104 of the element 103 to provide mechanical support for the head 17. [Circuit elements, such as 108, may also be mounted on surface 104 (see FIG. 12).] However to ensure that the head 17 is positively secured in place, preferably other securing devices are utilized. For example a bail wire assembly 109 (see FIGS. 6 and 12) may be provided which surrounds the sides and top of the 17 and is secured to the heat sink 96 or the mounting block 77 to releasably hold the ink jet head 17 down into contact with the top face 104 of the element 103. Also a pressure clamp 110 may be utilized. The pressure clamp 110 extends between the back 111 of the ink jet head 17 and the front surface 112 thereof to keep a constant tension between the housing which contains the head 17 and the outlet for the ink. The clamp 110 also prevents air from entering the head 17.

Figure 7:
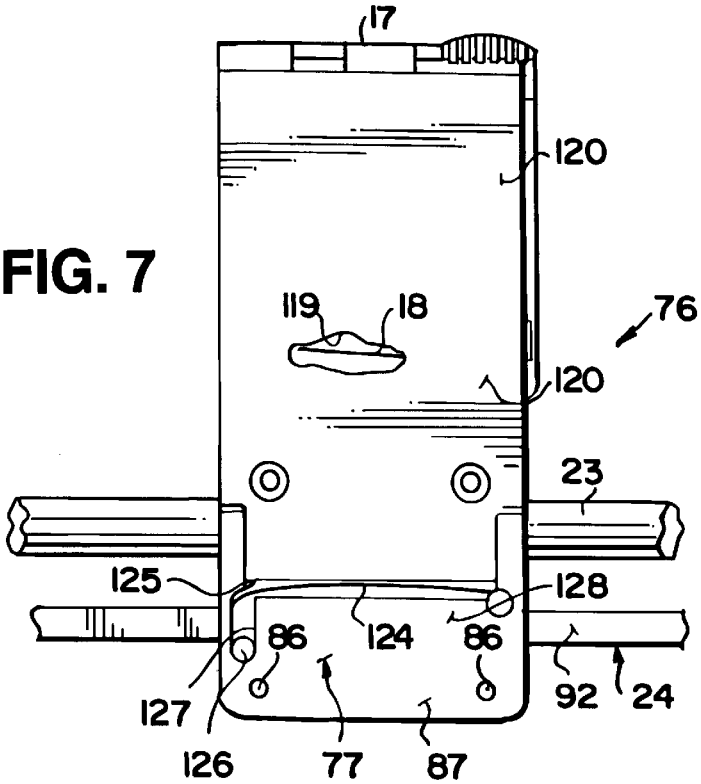
FIG. 7 is a front view of the structure of FIG. 6.

The front surface 112 of the ink jet head 17 has at least one nozzle (and preferably a plurality of nozzles) shown schematically at 113 in FIG. 6, extending outwardly therefrom. In the embodiment illustrated in FIGS. 6 and 7 the actual openings 18 for the nozzle 113 are positioned;as seen in FIG. 7, extending through an opening 119 in an ink mist absorbing plate 120.

The plate 120 preferably is of sintered metal, such as sintered stainless steel, and is positioned as illustrated so that it can absorb wayward ink and ink mist issuing from the openings 18 and/or rebounding from the paper or surrounding structures, and thereby preventing this wayward ink from clogging the nozzle 113. The sintered plate 120 preferably is removably but positively mounted in the position illustrated in FIGS. 6 and 7 by a magnetic material (e.g. steel) bar 122 adjacent the bottom thereof as seen most clearly in FIG. 6, which bar engages a permanent magnet 122 mounted within a channel 123 (see FIG. 8) of the mounting block 77. The magnet 122 acts through the bar 121 to positively hold the plate 120 (also of magnetic material, or of non-magnetic material like stainless steel with the steel bar 121 (fastened thereto)) in place, and cooperates with a spring, such as the leaf 124 (see FIG. 7) which engages the bottom 125 of the plate 120. The leaf spring 124 urges the plate 120 up into position against the nozzle 113, with the nozzle openings 18 extending into the opening 119 in the plate 120 as seen in FIG. 7. The leaf spring 124 is mounted by a pin 126 in a channel 127 engaging and formed in the face 128 (see FIGS. 6 through 8) of the mounting block 77.

In the use and assembly of the structure 76, the heat sink 96 is mounted to the top surface 95 of the mounting block 77, and so that the top surface 101 thereof engages the bottom surface 105 of the connection element 103, the pins 97, 100, 102 providing for proper positioning and connection of these components. The ink jet head 17 is plugged into contact with the pins 106 on the top surface 104 of the connection element 103, and the securing wire 109 is connected to hold the head 17 with a downward pressure and against lateral movement. The sintered metal ink absorbing plate 120 is readily removably mounted (to increase the serviceability of the head 17 by allowing replacement of the plate 120 when it is clogged with ink mist) by bringing it into contact with the bar 121 (or if the bar 121 is attached to plate 120 bringing both into contact with the magnet 120) through which the magnet 122 acts to hold the bottom of the plate 120 in place, with the leaf spring 124 biasing the plate 120 upward into position against the nozzle 113.

With the clip 81 detached, the structure 76 is then moved into operative association with the mounting bars 24, 25, the block 77 being moved with respect to the bar 23 so that the bar 23 passes through the mouth 84 of the channel 83 and into contact with the bushing 78, depressing the spring pressed plunger 79, which then snaps the bar 23 into place (as illustrated in FIG. 6) when the bushing 78 is securely engaged. Then the clip 81 is fastened in place by using the screw 94 to screw it to the block 77 so that the bar 24 is received by the groove 89 and also engages the top peripheries of the rollers 85 as also illustrated in FIG. 6. Then the thumb screw 80 is screwed through the clip 81 and the block 77.

The block 77, or the thumb screw 80 head 82, is moved along the bars 23, 24 (there being low friction movement due to the bronze bushing 78 and the rollers 85) until the head 17 is in the desired position for printing the web 19. At that position the thumb screw 80 is then tightened into contact with the bar 23, which securely holds the ink jet head 17 in the position regardless of vibration or other environmental conditions. Although the ink jet head 17 is positively held in position, it may be readily repositioned merely by loosening the thumb screw 80 by turning the head 82 thereof, and then moving the block 77 to a new position along the bars 23, 24. Also, the entire structure 76 may be readily replaced when the ink jet head 17 wears out or malfunctions without having to shut down the entire assembly 10 without interfering with the other ink jet heads 17 that are also associated with the bars 23, 24, or any other ink jet heads at any of the other levels 11 through 16. This is accomplished merely by detaching the clip 81 by removing the screw 94, which allows ready detachment from the bars 23, 24 in the reverse manner as described above with respect to attachment of the structure 76 to the bars 23, 24.

Figure 13:
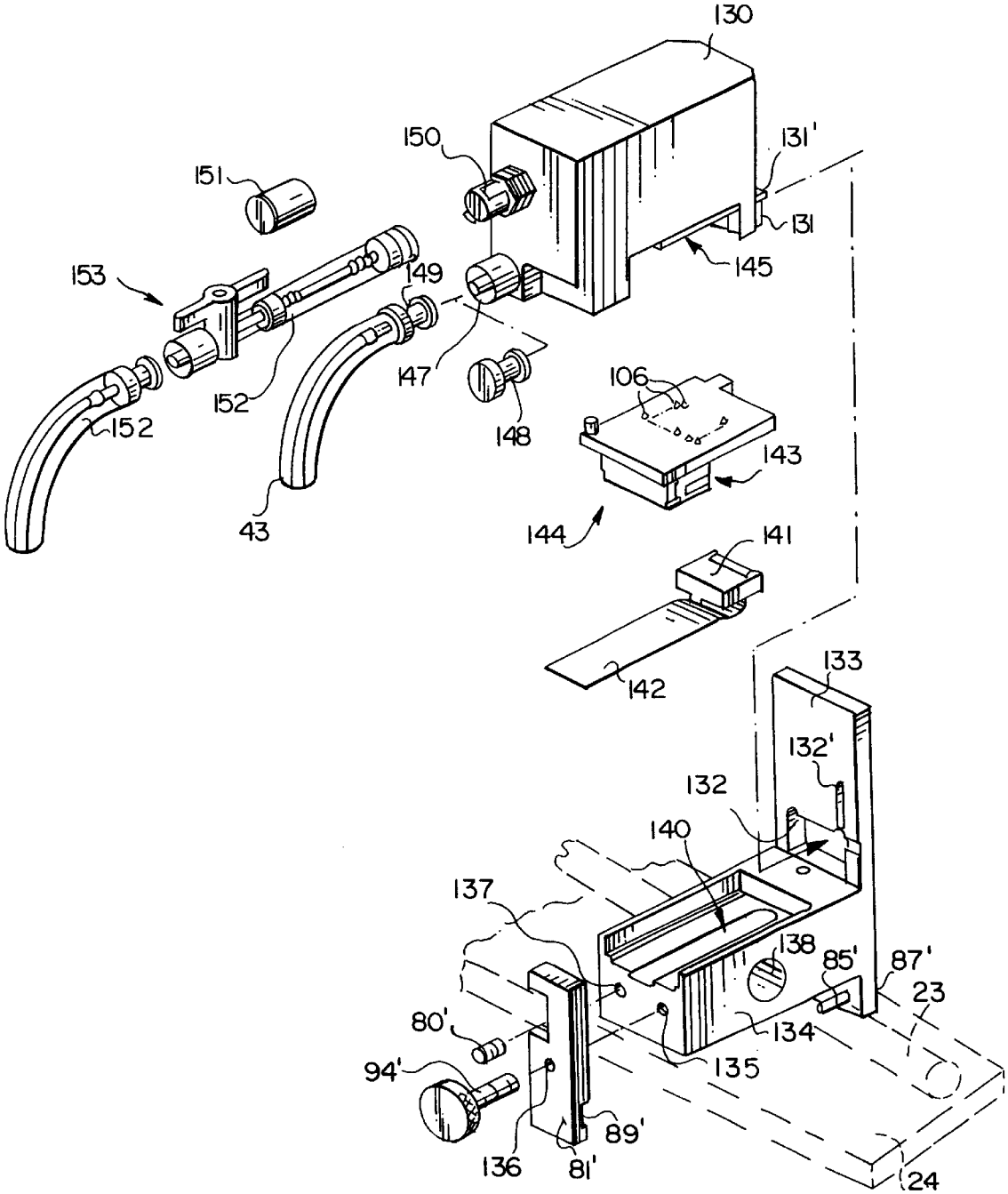
FIG. 13 is a top perspective exploded view of a second exemplary embodiment of a mounting arrangement for individual ink jet heads in an array, according to the present invention.

While the mounting structure illustrated in FIGS. 6 through 12 is preferred because of the advantages thereof, many other mounting structures and means could be provided. For example a single bar could under some circumstances be provided if it had a non-circular configuration (e.g. triangular or diamond shaped) for at least a portion thereof, and spring pressed clamping elements, fluid powered piston and cylinder assemblies, or the like, could also or alternatively be utilized. FIG. 13 illustrates another specific example the mounting structures that could be utilized.

In the FIG. 13 embodiment, the ink jet head 130 has a positioning structure 131 and one or more nozzles 131' which cooperate with the mounting opening 132 and nozzle slit 132', respectively, in the vertical support plate 133. Structures associated with the mounting block 134 that are comparable to those in the FIGS. 6 through 12 embodiment are shown by the same reference numeral only followed by a "'". The clip 81' is connected to or detached from the block 134 by screw threading it in and out of association with the screw threaded openings 135, 136 in the clip 81' and the block 134, respectively. The screw 80' is in the form of a set screw which can be rotated by an Allen wrench or the like, and it passes through the opening 137 which intersects the through extending substantially 360° of arc passage 138 in the block 134. Thus by detaching the clip 81' the bar 24 is moved out of engagement with the groove 89' and may be moved out of engagement with the rollers 85', and by loosening the screw 80' the position of the block 134 along the bar 23 may be adjusted. The passage 138 is substantially circular in cross-section and has a diameter slightly greater than the diameter of bar 23.

In the FIG. 13 embodiment the block 134 includes a contoured recess channel 140 in the top thereof into which the cartridge plug 141 and cartridge cable 142 may be disposed, with the plug 141 plugged into the receptacle portion 143 of the electrical connection element 144. The element 144 is similar in function to the element 103 in the FIGS. 6 through 12 embodiment, and may comprise a Pogo pin board having electrical pins 106 associated therewith which make an electrical connection with cooperating electrical elements in the bottom channel 145 of the ink jet head 130.

FIG. 13 also illustrates a particular connection that can be provided for the ink from the supply system 30 of FIG. 3, using the ink supply line 43 as also illustrated in FIG. 3 (connected up to the head 17 therein). For example the line 43 provides ink having a viscosity of between about 1.4–2 centipoise with a surface tension of between about 35–50 dynes per centimeter, of any color to head 130. The head 130 has an ink supply fitting 147 of conventional construction which may be covered during transport or when not in use by a plug cap 148, or during use connected up to the fitting 149 on the end of the ink supply line 43. The head/cartridge 130 also has a vent fitting 150 which either may be covered by a dust cap 151, or connected up to a conventional vent hose assembly 152. The vent hose assembly 152 may have a conventional valve 153 disposed therein.

The assembly of FIG. 13 has basically the same advantages as the embodiment of FIGS. 6 through 12 except that it is more difficult to remove the mounting block 134 from the first bar 23 because the arcuate opening/passageway 138 surrounds the bar 23. However the block 134 may be removed from the bar 23 by detaching the bar 23 at one of its ends, and also the actual cartridge 130 itself may be detached from the mounting bracket 134 more easily than in the FIGS. 6 through 12 embodiment.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A modular ink delivery system for a multi level array of ink jet heads, comprising:

a plurality of vertically spaced levels;

a plurality of arrays of ink jet heads, said arrays provided in said plurality of vertically spaced levels;

a plurality of ink containing chambers, at least one ink containing chamber for each array, positioned approximately at the level of each array, stacked one atop another, each chamber having a top and a bottom, the bottom of at least some chambers operatively engaging the top of another of said chambers;

a fluid connection from each chamber to at least one ink jet head of each of said arrays associated with each said chamber; and means for automatically supplying ink to all of said chambers.

2. A system as recited in claim 1 wherein each of said chambers has a fluid connection between each of said chambers and any chamber immediately above or below each of said chambers; and wherein said plurality of chambers includes an upper chamber; and wherein said means for automatically supplying ink to all of said chambers comprises a pump and a conduit leading from said pump to said upper chamber for feeding ink into a top portion of said upper chamber so that the ink cascades downwardly from said upper chamber to chambers located below said upper chamber through said fluid connections between chambers.

3. A system as recited in claim 2 wherein each of at least some of said chambers has a first standpipe connected to said top thereof and a second standpipe connected to said bottom thereof, and wherein said first and second standpipes are offset from each other.

4. A system as recited in claim 3 wherein said ink jet heads of one of said arrays are connected to one of said chambers at a first vertical position; and wherein said second standpipe in said chamber has an open top disposed at a second vertical position, higher than said first vertical position so that said one of said chambers supplies ink to said ink jet heads connected thereto before cascading ink downwardly.

5. A system as recited in claim 4 wherein each ink jet of one of said arrays connected to said chamber has a separate hose fitting head to said chamber.

6. A system as recited in claim 2 further comprising a single lid which provides the bottom of a first one of said chambers and the top of a second one of said chambers, said lid having at least one O-ring associated therewith for sealing said second one of said chambers.

7. A system as recited in claim 6 wherein said lid is substantially permanently sealingly affixed to said first one of said chambers.

8. A system as recited in claim 2 further comprising ink provided in said chambers, said ink having a viscosity of between about 1.4–2 centipoise, and a surface tension of between about 35–50 dynes/cm.

9. A system as recited in claim 1 further comprises a vacuum degasser for de-aerating ink flowing from at least one of said chambers to at least one of said arrays.

10. A system as recited in claim 5 further comprising a vacuum degasser for de-aerating ink flowing therethrough provided between each of said chambers and said arrays.

11. A system as recited in claim 2 further comprising a common support structure within which said chambers are stacked one atop the other, and a clamp for clamping said chambers within said common support structure.

12. A system as recited in claim 11 wherein said stacked chambers include a lowermost chamber; and further comprising an ink reservoir, a first conduit connecting said ink reservoir to said pump, and a second conduit from a bottom portion of said lowermost of said stacked chambers for returning ink to said reservoir by gravity flow.

13. A system as recited in claim 1 further comprising at each level a first generally horizontally extending bar, and first means for mounting each of said ink jet heads on said first bar so that said ink jet heads are securely held to said first bar, but are readily removably individually detached from said first bar for repair or replacement without affecting others of said ink jet heads on any level.

14. A system as recited in claim 13 further comprising an electrical connection element for supplying activation signals to said ink jet head; and wherein said first means for mounting each said ink jet head comprises: a heat sink having a top on which said ink jet head and said electrical connection element are mounted, and a bottom; and a releasable attachment to said first bar mounted to said bottom of said heat sink.

15. A system as recited in claim 1 further comprising a sintered metal plate; and wherein each of said ink jet heads has a front surface with at least one nozzle for spraying ink therefrom, and wherein said sintered metal plate Is positioned with respect to said front surface to absorb wayward ink in ink mist issuing from said nozzle.

16. A system as recited in claim 15 further comprising a magnet and leaf spring to releasably mounting said sintered metal plate with respect to said front surface.

17. A system as recited in claim 13 further comprising at each level a second generally horizontally extending bar, and second means for mounting each of said ink jet heads on said second bar so that said ink jet heads are readily movable with respect to and guided by said second bar, said first bar hand second bar being substantially parallel to each other and spaced from each other.

18. A system as recited in claim 17 wherein said first bar is substantially circular in cross section and said second bar is distinctly non-circular in cross section.

19. A modular assembly comprising:

a plurality of ink jet heads provided in an array;

a first generally horizontally extending bar;

a second generally horizontally extending bar substantially parallel to said first bar; and for each ink jet head: first mounting means for mounting said ink jet head on said first bar so that said ink jet head is securely held to said first bar but is readily movable along said first bar; second mounting means for mounting said ink jet head on said second bar so that said head is readily movable along and guided by said second bar; and an electrical connection element mounted by said first and second mounting means for supplying activation signals to said ink jet head; and wherein said first mounting means and said second mounting means include: a common heat sink having a top and a bottom, said electrical connection element and said ink jet head mounted on said top of said heat sink, and said first and second bars attached to said bottom of said heat sink.

20. A modular assembly comprising:

a plurality of ink jet heads provided in an array;

a first generally horizontally extending bar;

a second generally horizontally extending bar substantially parallel to said first bar; and for each ink jet head: first mounting means for mounting said ink jet head on said first bar so that said ink jet head is securely held to said first bar but is readily movable along said first bar; second mounting means for mounting said ink jet head on said second bar so that said head is readily movable along and guided by said second bar; and an electrical connection element mounted by said first and second mounting means for supplying activation signals to said ink jet head; and wherein said second bar has a first side edge and a second side edge and a bottom; and wherein said first mounting means and said second mounting means comprise: an arcuate bushing, having an arcuate extent of at least about 100°, for engaging said first bar; a removable clip with a channel for engaging said bottom of said second bar adjacent said first side edge; and at least one roller for engaging said bottom of said second bar adjacent said second side edge.

21. A system as recited in claim 19 wherein said second bar has a first side edge and a second side edge and a bottom; and wherein said first and second bars are attached to said bottom of said heat sink by: an arcuate bushing, having an arcuate extent of at least about 100°, for engaging said first bar; a removable clip with a channel for engaging said first side edge and said bottom of said second bar; and at least one roller and cooperating support for said roller for engaging said second side edge and said bottom of said second bar.

22. A system as recited in claim 21 wherein said arcuate bushing has an arcuate extent of 180° or less, and wherein said first mounting means further includes a first screw movable with respect to said arcuate bushing for movement into a position tightly holding said arcuate bushing in a stationary position with respect to said first bar.

23. A system as recited in claim 22 wherein said first mounting means further comprises at least one spring pressed plunger extending from said arcuate bushing into contact with said first bar.

24. A system as recited in claim 19 wherein said second bar has a first side edge and a second side edge and a bottom; and wherein said first mounting means and said second mounting means comprise: an arcuate bushing, having an arcuate extent of at least about 100°, for engaging said first bar; a removable clip with a channel for engaging said bottom of said second bar adjacent said first side edge; and at least one roller for engaging said bottom of said second bar adjacent said second side edge.

25. A system as recited in claim 24 wherein said arcuate bushing has an arcuate extent of 180° or less, and wherein said first mounting means further includes a first screw movable with respect to said arcuate bushing for movement into a position tightly holding said arcuate bushing in a stationary position with respect to said first bar.

26. A system as recited in claim 25 wherein said first mounting means further comprises at least one spring pressed plunger extending from said arcuate bushing into contact with said first bar.

27. A system as recited in claim 24 wherein said first bar is circular in cross-section, and wherein said arcuate bushing has an arcuate extent of substantially 360° and is substantially circular in cross-section, having a diameter slightly greater than the diameter of said first bar.

28. A system as recited in claim 19 further comprising a sintered metal plate; and wherein each of said ink jet heads has a front surface with at least one nozzle for spraying ink therefrom, and wherein said sintered metal plate is positioned with respect to said front surface to absorb wayward ink in ink mist issuing from said nozzle.

29. A modular ink jet assembly comprising:

a plurality of ink jet heads provided in an array;

a first generally horizontally extending bar; and for each ink jet head: first mounting means for mounting said ink jet head on said bar so that said ink jet head is securely held to said bar but is readily movable along said bar and individually detachable from said bar for repair or replacement without affecting others of said ink jet heads; said mounting means comprising: an open channel-defining bushing engaging said bar; at least one spring pressed plunger biased into engagement with said bar in said bushing; a first screw movable with respect to said bushing for movement into a position tightly holding said arcuate bushing in a stationary position with respect to said; and an electrical connection element mounted by said first mounting means for supplying activation signals to said ink jet head.

30. An ink jet system comprising:

an ink jet head having a front surface with at least one nozzle for spraying ink therefrom;

a sintered metal plate of magnetic material or having magnetic material attached thereto, positioned with respect to said front surface for absorbing wayward ink and ink mist issuing from said nozzle or rebounding from surfaces onto which ink is directed; and a magnet and spring which releasably mounts said sintered plate with respect to said front surface to absorb wayward ink and ink mist issuing from said nozzle or rebounding from surfaces onto which ink is directed.

* * * * *